United States Patent [19]

Ferrill et al.

[11] 4,283,105

[45] Aug. 11, 1981

[54] TERMINAL FOR CROSS CONNECT APPARATUS

[75] Inventors: Jess B. Ferrill, Greensboro; Richard L. Hughes, Clemmens; Melvin A. Soderstrom, Advance, all of N.C.

[73] Assignee: AMP Incorporated, Harrisburg, Pa.

[21] Appl. No.: 101,373

[22] Filed: Dec. 7, 1979

[51] Int. Cl.[3] ..... H01R 4/24

[52] U.S. Cl. ..... 339/97 R; 339/119 R; 339/217 S

[58] Field of Search ..... 339/217 S, 96, 97 R, 339/97 P, 98, 99, 119 R

[56] References Cited

U.S. PATENT DOCUMENTS

| | | | |
|---|---|---|---|
| 2,317,450 | 4/1943 | Folds et al. | 174/60 |
| 3,147,058 | 9/1964 | Zdanis | 339/97 R |
| 3,845,455 | 10/1974 | Shoemaker | 339/97 R |
| 3,957,337 | 5/1976 | Damiano | 339/217 S |
| 4,010,996 | 3/1977 | Hopkins et al. | 339/47 R |
| 4,141,618 | 2/1979 | Reavis, Jr. et al. | 339/97 P |

FOREIGN PATENT DOCUMENTS

| | | | |
|---|---|---|---|
| 1434003 | 4/1976 | United Kingdom | 339/98 |

OTHER PUBLICATIONS

"Gold Mine", Advertising Brochure, Communication Apparatus Co.

*Primary Examiner*—John McQuade

[57] ABSTRACT

A terminal board and mounting frame are disclosed. Electrical terminals are arranged in rows and columns on the terminal board and are adapted for splicing or cross connecting high density communication wiring for communications, data processing, telemetry, signal control and broadcasting applications. The terminals are sleeve form blanks having wire receiving open seams in which wires are electrically connected by forcible insertion along the seams.

5 Claims, 14 Drawing Figures

TERMINAL FOR CROSS CONNECT APPARATUS

FIELD OF THE INVENTION

The present invention relates to a slotted electrical terminal in which one or more wires are electrically connected, and also to a cross connect apparatus in which large numbers of the terminals are mounted, and adapted to splice together the greatest number of electrical wires in the smallest space.

BACKGROUND OF THE PRIOR ART

A typical cross connect apparatus includes a panel on which are provided large numbers of electrical terminals. The terminals are arranged in columns and rows, closely spaced together. The terminals are used for splicing communication wiring, or for cross connecting the wiring of one cable with the corresponding wiring of one or more additional cables.

In one such apparatus, the terminals comprise internally threaded posts. Wire connections are made by stripping insulation off the ends of the wires, wrapping the exposed conductors around the shank of a screw and then threadably securing the screw tightly into the post.

Another cross connect apparatus comprises a terminal board having a plurality of posts which are hollow sockets. Wires are cross connected, by connecting a pin to each wire and then intermating the pin in a desired socket.

In the present invention, a circuit board is provided with electrical terminals in the form of longitudinally slotted barrels. Electrical connections are made by forcibly inserting one or more wires axially of their lengths along the slot of a barrel. During insertion each wire is forced over a cutting edge on the terminal, thus trimming the wire to length. Electrical connection is made without having to strip the wire. The slot is provided with tandem sections, tailored for the multiple functions of slicing the wire insulation, flattening the conductor and gathering strands of the conductor.

OBJECTS

An object of the present invention is to provide a slotted barrel terminal for use in a cross connect apparatus in which the wire receiving slot of the terminal is provided with tandem sections configured to perform the functions of insulation slicing and conductor flattening and conductor strand gathering.

Another object of the invention is to provide a slotted barrel terminal which is self locking in a panel and which provides for electrical connection of one or more wires along a slot of the terminal which projects outwardly of either side of the panel.

Other objects and advantages of the present invention will become apparent from the following detailed description taken in conjunction with the drawings.

DRAWINGS

Figure 1:
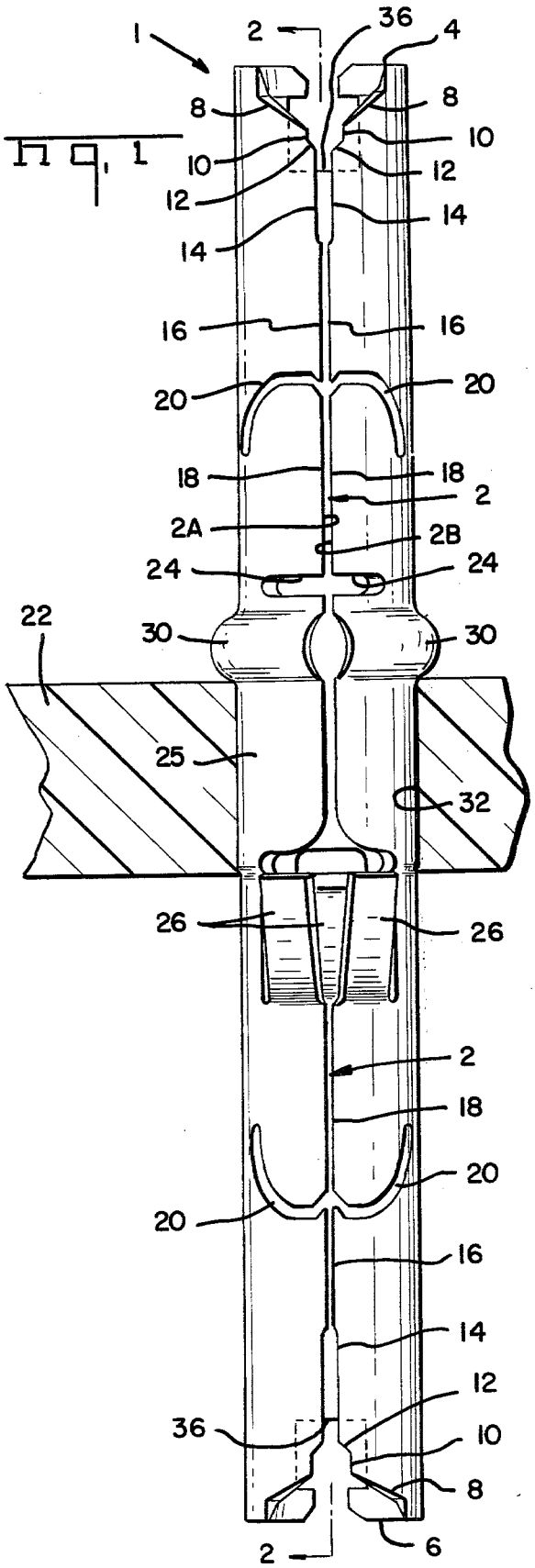
FIG. 1 is an enlarged elevation of a terminal according to the present invention.
Figure 5:
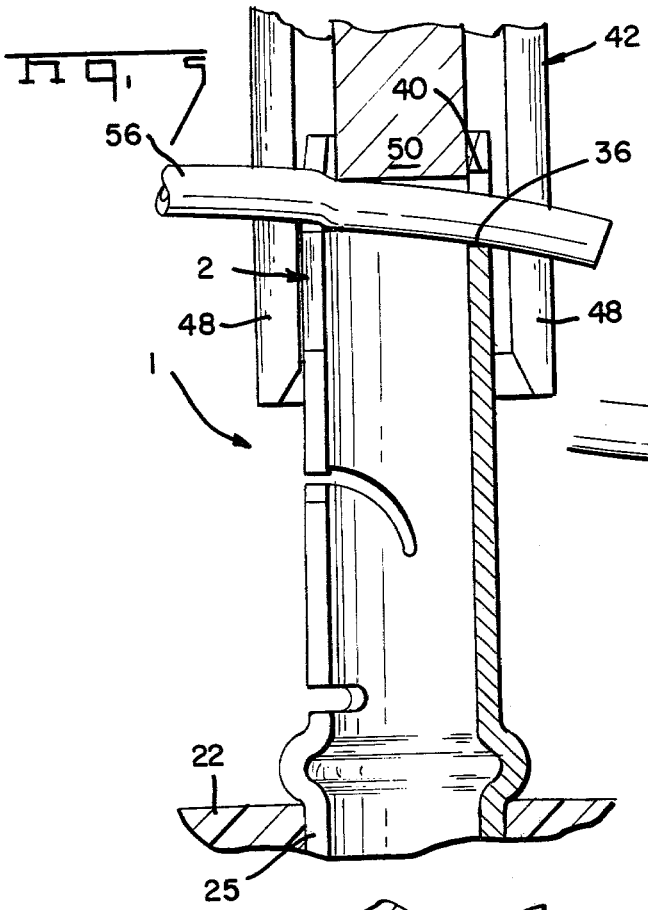
Figure 6:
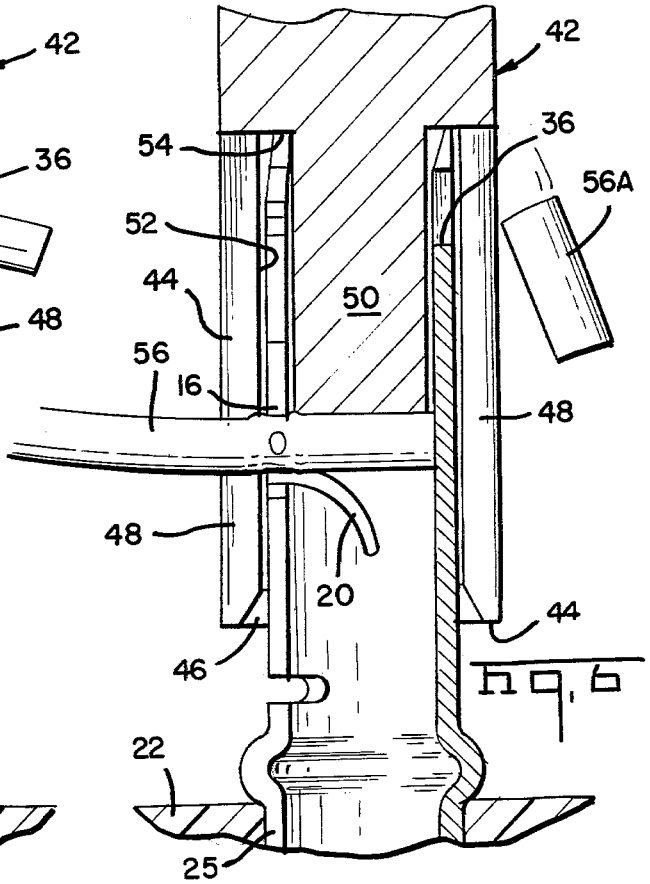
Figure 7:
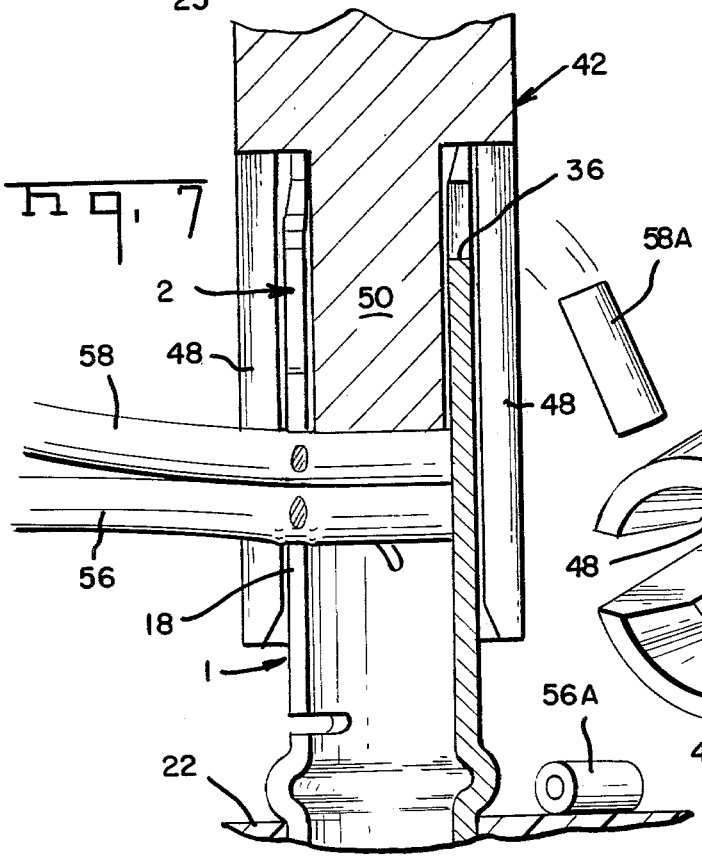

FIGS. 5, 6, and 7 are enlarged fragmentary elevations in section of a portion of the terminal of FIG. 1 illustrating the various stages of wire insertion into the terminal slot.

Figure 8:
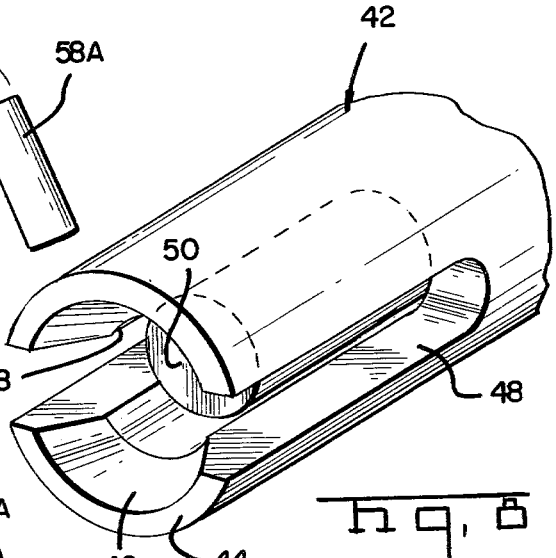

FIG. 8 is an enlarged fragmentary perspective of the insertion tool for inserting one or more wires into the terminal as shown in FIGS. 5, 6, and 7.

Figure 9:
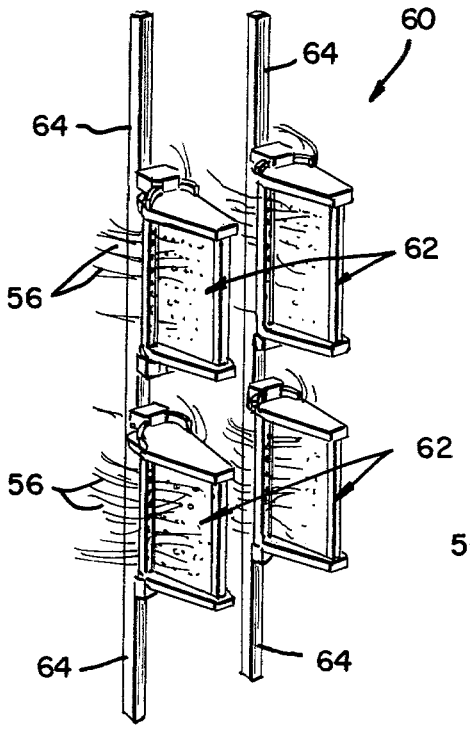

FIG. 9 is a perspective of a cross connect apparatus.

Figure 10:
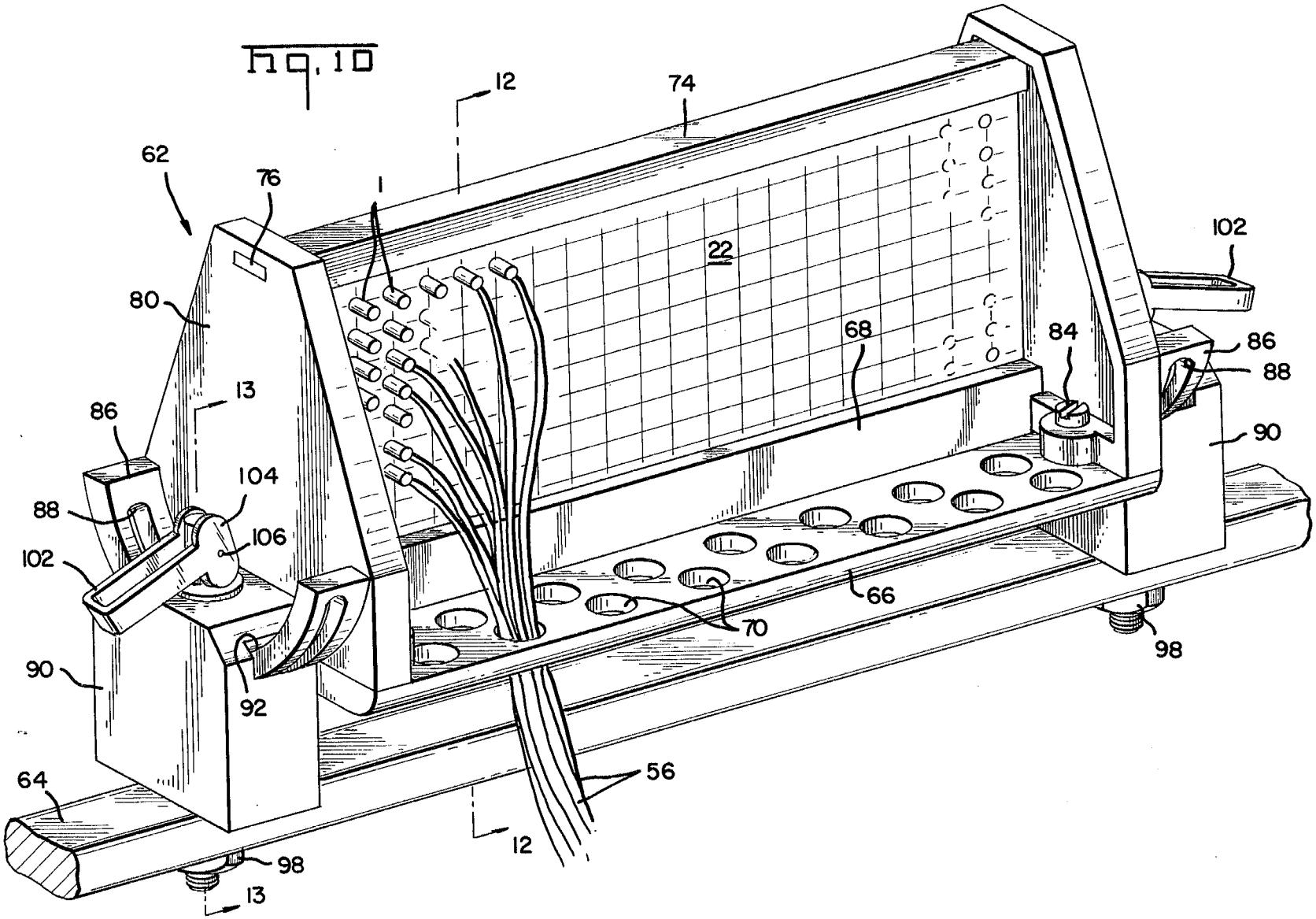

FIG. 10 is an enlarged perspective of a wiring module of the apparatus shown in FIG. 9.

Figure 11:
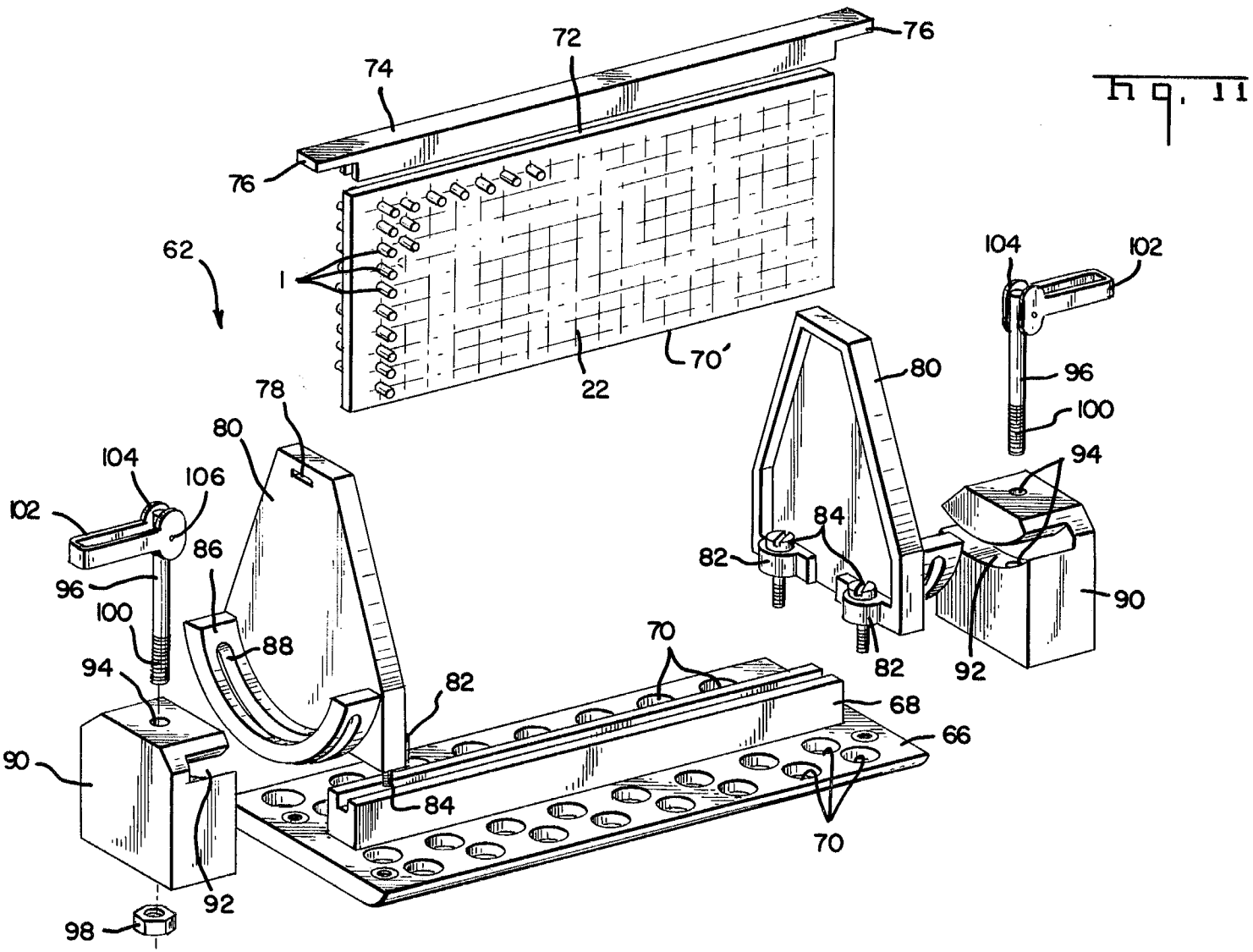

FIG. 11 is a perspective with parts in exploded configuration of the module shown in FIG. 10.

Figure 12:
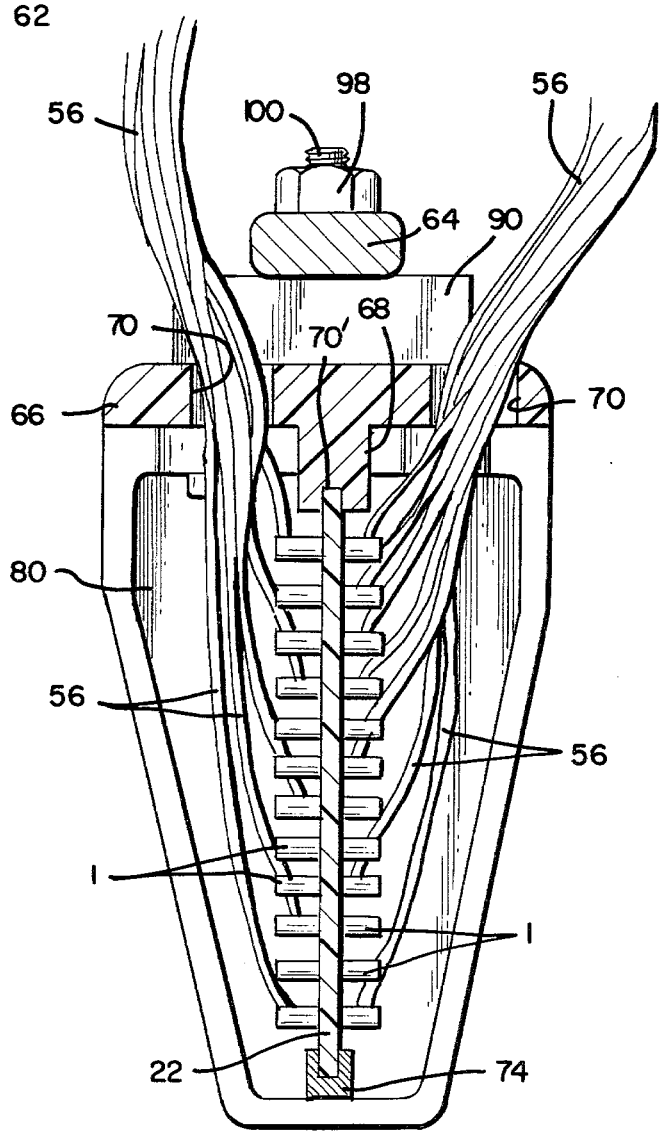

FIG. 12 is an enlarged section of the wiring module shown in FIG. 10.

Figure 13:
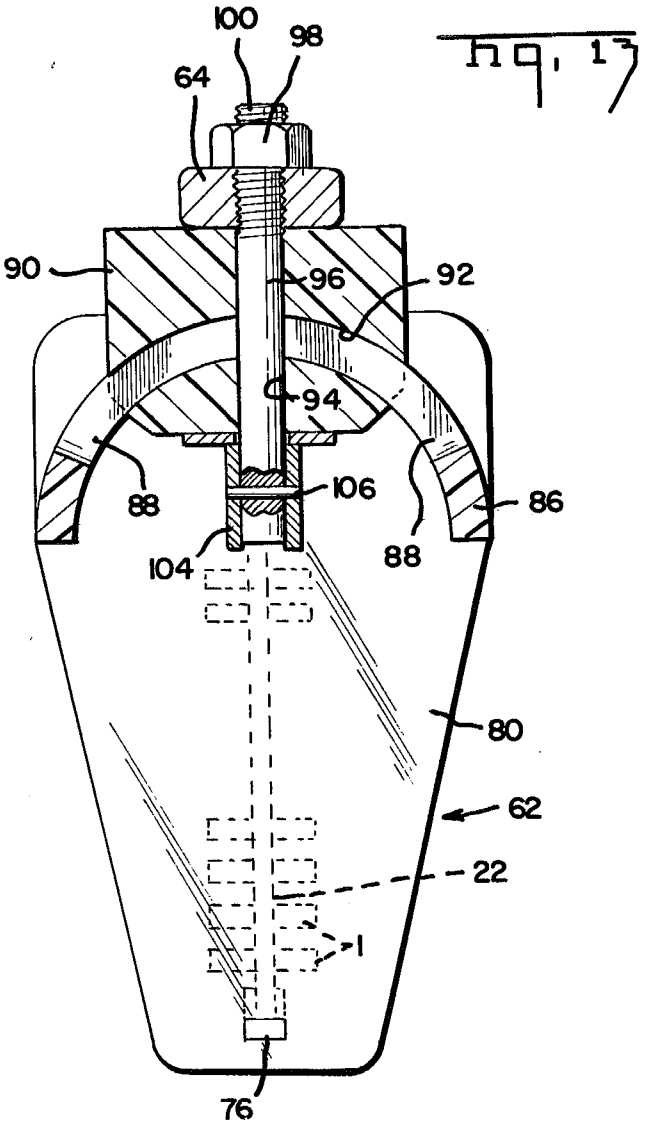
Figure 14:
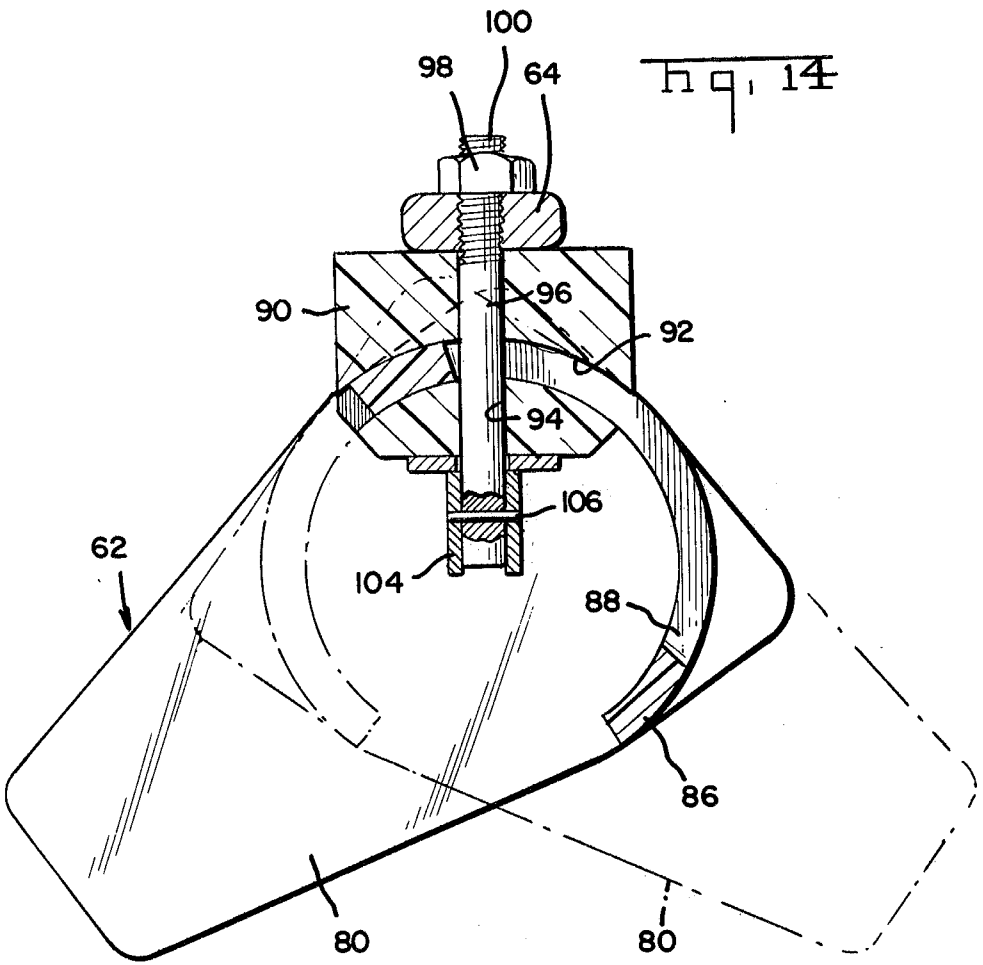

FIGS. 13 and 14 are sections of the wiring module of FIG. 12.

DETAILED DESCRIPTION

Figure 2:
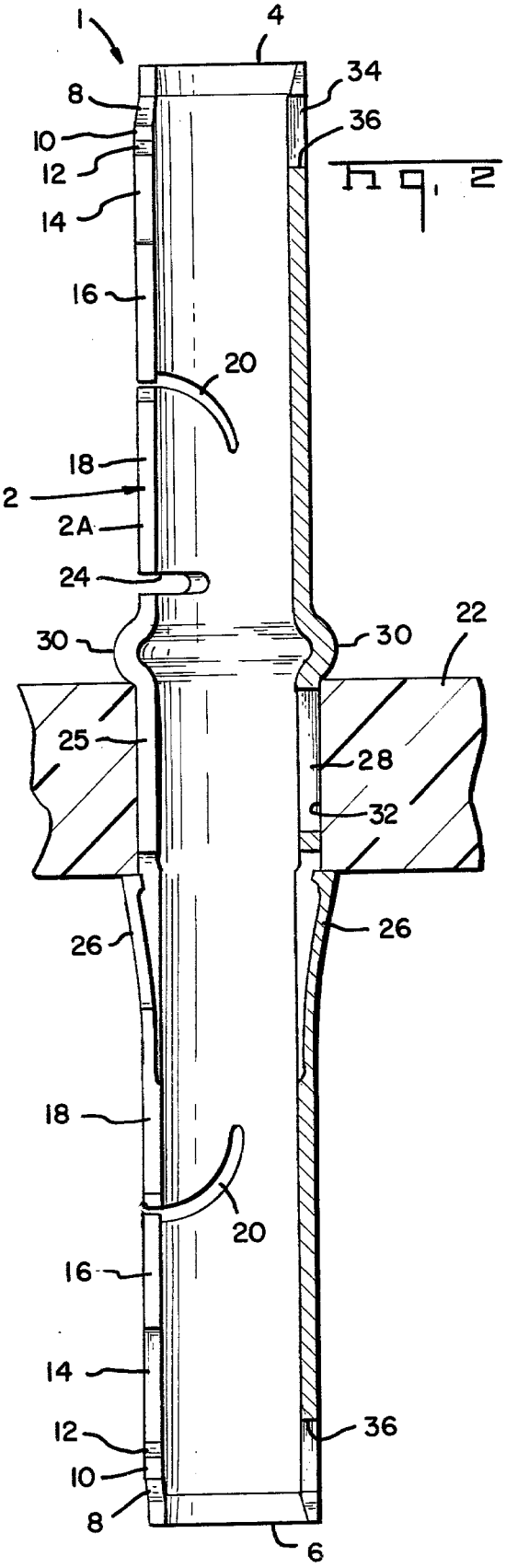
FIG. 2 is a section taken along the line 2—2 of FIG. 1.
Figures 3, 4:
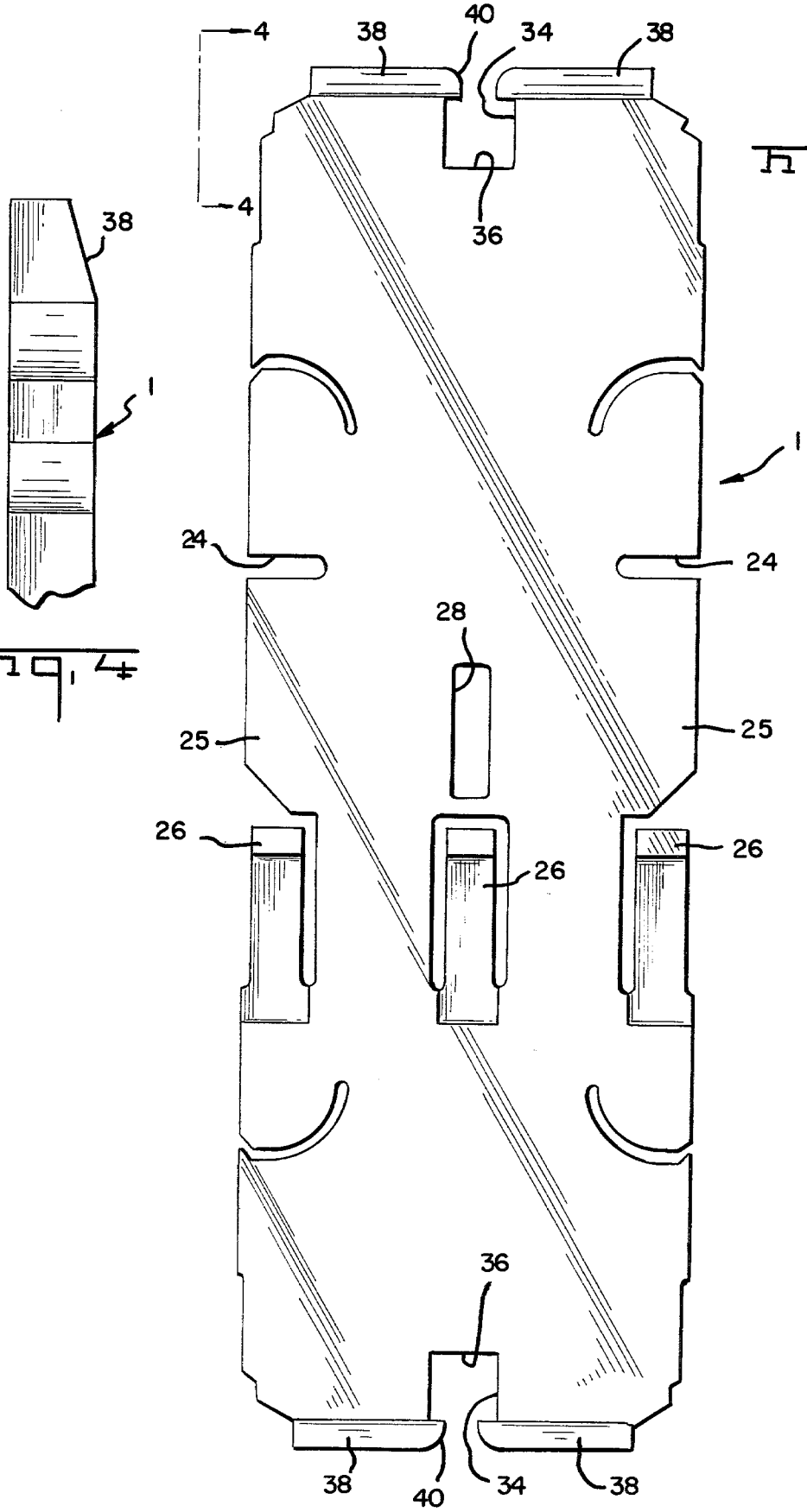
FIG. 3 is an enlarged plan view of a blank of the terminal prior to being formed into a barrel configuration.
FIG. 4 is a fragmentary elevation viewed along the line 4—4 of FIG. 3.

FIGS. 1–4 illustrate a barrel shaped terminal 1, the blank of which is illustrated in FIG. 3. The flat blank is rolled into a tubular barrel or sleeve configuration having a longitudinal open seam 2 in which one or more wires are to be connected. Adjacent each open end 4 and 6 of the terminal, the seam is provided with a pair of diagonally converging cutting edges 8 communicating with the open end 4 or 6 of the terminal. Another tandem section of the slot 10 has axially aligned edges 10. A third tandem section 12 is defined by diagonally converging edges 12 on opposite sides of the seam 2. Another tandem section of the seam is provided with axially aligned opposed edges 14. Another tandem section of the seam is provided by closely spaced apart axially aligned edges 16. Another tandem section of the seam 2 is provided by spaced apart edges 18. A transverse slot 20 intersects the same and separates the edges 16 from the edges 18.

The edges 8 are inclined 45 degrees from the axis of the seam 2. A range of insulated wire sizes, or diameters, may be terminated in the seam 2. The width of the seam separating the edges 10 is equivalent to the diameter of the conductor portion of an insulated wire of the mid-range size, with the wire in the seam section defined by the edges 10. It is noted that insertion of an insulated wire within the seam section will open the seam slightly, although excessive opening is resisted by resiliency in the terminal. As a wire is inserted into the seam section between the edges 10, the edges 8 will slice through the insulation on an insulated wire of mid-range diameter and larger. In addition, the 45 degree angle provided on the edges 8 will apply compression loading on opposite sides of a larger diameter conductor within the range. If the larger diameter conductor is stranded wire, the strands will tend to be gathered by the edges 8. The axial length of the edges 10 are equivalent to one-half the maximum conductor diameter of an insulated wire within the range. Further insertion of an insulated wire along the seam 2 will cause the wire to enter the seam section defined between the edges 12 inclined at an angle of 30 degrees with respect to the axis of the seam. The edges 12 provide compression lead-in surfaces to indent opposite sides of a conductor portion of an insulated wire without cutting the strands of the wire or without cutting into a solid conductor. The surfaces 12 thereby deform or flatten the conductor from a circular diameter to an oblong shape, or elongated shape, and establish electrical with the elongated sides of the conductor, where insulation was previously sliced through by the edges along the seam. The wire then is forced along the seam into another seam section defined between conductor gripping edges 14 which engage the conductor portion of the inserted wire to establish the electrical connection. The edges 14 thereby provide jaws which are opened slightly by the presence of a conductor therebetween. Resiliency in the circular periphery of the terminal resiliently resist opening or separation of the jaws, and applies resilient compression on the conductor. The wire gripping jaws 14 may further be reduced in width by the edges of the seam section 16 immediately adjacent to the transverse slot 20. This seam section is of optional width and is provided only to deform the diameter of the wire to an extreme elongated configuration, thereby to increase the total area of contact between the seam edges and the elongated dimension of the deformed conductor. Thus, each tandem seam section is of narrower width than the previous seam section. A second set of resilient jaws 18 is provided by opposed edges in another tandem section of the seam separated from the jaws 16 by the transverse arcuate slot 20 which intersects the seam 2.

At the intersection of the edge 8 with the edge 10, a relatively sharp radius is provided to insure that the edge 8 will slice through the insulation of a wire of appropriate diameter. At the intersection of the edges 12 and 14 a larger, more flattened radius is provided to prevent slicing and to promote gathering individual strands of the conductor. Therefore only the smallest diameters within the range will have their insulation sliced through by the edges 12. In the mid-range and larger sizes, the insulation will have been sliced through in the preceding slot sections.

As shown in FIGS. 1, 2, and 3, the terminal 1 is adapted for insertion through the thickness of a panel board or circuit board 22. FIG. 3 shows the blank provided with aligned notches 24 which intersect the seam 2. A longitudinal section 25 of the blank is equal in length to the width of the panel 22 and is defined between a slot 24 and a resilient finger 26 projecting as a cantelever beam longitudinally of the blank and along the edges 2A and 2B which form the open seam 2. The blank section 25 is provided with an opening 28. In order to improve the stiffness and strength of the fingers 26, they are forged by a coining operation, such that they become thinner but work hardened by the process, and are formed to diverge outward diagonally of the plane of the blank. The blank is then subjected to a forming operation to provide a radially outward bulged collar 30 adjacent to the terminal section 25. The blank is then formed into the sleeve or barrel configuration such that the fingers 26 project radially outward from the blank and lie adjacent the cylindrical section 25 of the blank. The notches 24 permit the collar to be suspended against the surface of the board 22 independently of the section 25 which is inserted through an aperture 32 of the board. The fingers 26 are first deflected radially inward of the barrel as the same is inserted vertically into the board 22 as viewed in FIGS. 1 and 2. Subsequently, the fingers 26 spring radially outward to impinge against an under surface of the board.

Further as shown in FIGS. 1, 2, and 3, each end of the terminal is provided with a vertical rectangular notch 34 aligned with the seam 2 and having a surface 36. End margins 38 of the terminal on either side of the notch 34 are coined to increase the stiffness thereof. The edge margins overhang the notch 34 and provide a narrow entryway 40 to the notch 36.

FIG. 8 illustrates the end of a wire insertion tool illustrated generally at 42. The tool includes an outer cylindrical member 44 having an open end 46 and aligned slots 48 communicating with the open end 46. A central cylindrical member 50 is concentric with the outer member 44. A cylindrical clearance or cavity 52 is provided between the members 44 and 50. The bottom of the cavity is illustrated in FIG. 6 at 54.

In operation, an insulated wire 56 is located in an open end of the barrel terminal 1. The wire is forced through the narrow entry 40 to register within the notch 36. The remainder of the wire passes through the open seam 2 initially between the slicing edges 8. The tool 42 is then driven over the terminal 1 in a telescopic manner. The member 50 will enter the open end of the terminal 1 to initially engage that portion of the wire 56 within the confines of the terminal. The wire will pass through the openings 48 of the tool. The wire slopes inward of the terminal toward the notch 36, pushing the tool member 50 against the cutting edge 36. Further movement of the tool 42 along the terminal 1 will force the member 50 to enter the confines of the terminal, forcibly inserting the wire 56 axially of its length along the successive or tandem sections of the seam 2 until the conductor is gripped between the wire gripping jaws 16. The open end of the terminal 1 will enter and then bottom against the end 54 of the tool cavity 52 preventing further insertion of the wire 56. Further as shown in FIG. 6, the portion of wire which projects through the notch 34 will be forced over the cutting edge 36, whereby a remainder portion 56A of the wire is cut off upon insertion of the wire along the terminal.

FIG. 7 illustrates a repeated operation whereby an additional wire 58 is connected to the terminal 1. Again the member 50 of the tool 42 will urge the additional wire 58 along the open seam 2 of the terminal, forcing a remainder portion 58A of the wire 58 over the cutting edge 36 such that it becomes severed from the wire 58. The member 50 forcibly urges the wire 58 axially of its length along the tandem section of the seam 2 until the wire 58 engages the first wire 56 and urges the same along the seam 2 in registration between the jaws 18 of the terminal 1. In the completed assembly, the additional wire 58 will be terminated between the jaws 16 of the terminal 1.

FIG. 9 diagramatically illustrates at 60 a cross connect system in which individual wiring modules 62 are secured to spaced rails 64. The details of a module are illustrated in FIGS. 10 and 11. Each module includes a molded base 66 having a central channel 68 and wire dressing openings 70 through the base 66 on either side of the channel 68. The panel board 22, having a plurality of terminals 1 mounted in densely spaced columns and rows, has one of its edge margins 70' received in the rail 68. An opposite edge margin 72 is received in a top channel 74. The ends 76 of the channel 74 are in the forms of tabs which assemble into slots 78 provided in end walls 80. Each end wall 80 is molded from a rigid plastic material and provided with integral bosses 82 through which threaded fasteners 84 are mounted for securing the end wall to the base 66 at an end of the channel 68. Each end wall 80 is provided with an arcuate track 86 having a central slot 88. A mounting block 90 is provided with an arcuate recess 92 which slidably receives the track 86. A vertical bore 94 passes through the block intercepting the recess 92. An elongated bolt 96 passes freely through the bore 94, and through the slot 88 of a track 86. The bolt is secured in place with a nut 98 threadably secured over a threaded end 100 of the bolt. The other end of the bolt is provided with a U-shaped metal stamping serving as a lever 102 formed at one end with an arcuate clevis 104 which is pivotally secured by a pin 106 to the bolt 96. The bolt 96 passes through a mounting rail 64 to secure the module thereto. The pin 106 is offset on the arcuate surface of the clevis 104 such that with the lever 102 in the position shown in FIG. 10, the larger radius of the clevis 104 will press on the block 90 tending to close the recess 92 on the rail 86 retaining the same in position. Rotation of the lever will rotate the smaller radius of the clevis over the block 90, to release pressure of the clevis on the block, allowing the recess 92 to open, and allowing slidable adjustment of the track 86 in respect to the block 90. FIGS. 10 and 12 illustrate communication wires 56 laced through selected openings 70 in the base 66 and then electrically connected or terminated to corresponding terminals 1 mounted on the board 22. FIG. 13 illustrates that each wiring module 62 can be pivoted by movement of its tracks 88 along the mounting blocks 90 in order to swing the circuit board or panel board 22 to a position more accessible for lacing and terminating wires.

Although a preferred embodiment of the present invention is disclosed, other embodiments and modifications thereof which would be apparent to one having ordinary skill is intended to be covered by the spirit and scope of the appended claims.

What is claimed is:

1. An electrical terminal comprised of a single blank of tubular sleeve form having a wire receiving, longitudinal open seam intersected by at least one slot transversely of said sleeve form and defining tandem pairs of wiring gripping jaws on opposite sides of said seam, said seam further including tandem seam sections each of narrower width than the previous section, a first said section having a progressively converging width initially greater than the width of an insulated wire inserted in said first section, a second said section having a width equal to the midrange diameter of a conductor portion of said insulated wire selected from a range of insulated wire diameters, a third said section having a width less than the width of said second section, a fourth said section having a width less than the width of said conductor portion of said insulated wire, said terminal having a first pair of resilient wire engaging jaws at said fourth section, said seam providing a second pair of resilient wire engaging jaws, spaced apart across a width of said seam which is less than the width of said conductor portion of said insulated wire, said second pair of said jaws being separated from said fourth section by said slot, and metal edge surfaces at each of said first, second and third sections on opposite sides of said seam, and selectively oriented at an angle with respect to the axis of said slot to provide slicing of an insulated portion of said insulated wire and indentation flattening of said conductor portion without cutting the same.

2. The terminal as recited in claim 1, wherein, said sleeve form blank includes a radially outwardly bulged portion adapted to seat against a surface of a panel board through which said blank projects, and said blank includes a plurality of resilient fingers struck outwardly from the periphery of said sleeve form and adapted for resilient deflection radially inward of said sleeve form to pass through an aperture of said board and to resiliently spring outwardly of said sleeve form to engage a surface of said panel board.

3. The structure as recited in claim 2, wherein, said first section opens into an open end of said blank.

4. The structure as recited in claim 3, wherein, said seam intersects a second open end of said sleeve form blank, said seam including fifth, sixth, seventh, eighth, and ninth, sections similar, respectively, to said tandem sections.

5. The structure as recited in claim 4 and further including:

rail means, a frame mounting said panel board, and means for securing said frame to said rail means, said frame having arcuate track means for pivoting said frame on said rail means, and releasable lock means for locking said track means in position on said rail means.

* * * * *